US006039392A

United States Patent [19]

Dencker

[11] Patent Number: 6,039,392

[45] Date of Patent: Mar. 21, 2000

[54] DESK AND GROUP OF SIMILAR DESKS

[76] Inventor: Nils Dencker, Brandstorpsväegen 7, 263 91 Hoeganaes, Sweden

[21] Appl. No.: 09/029,167

[22] PCT Filed: Oct. 10, 1996

[86] PCT No.: PCT/SE96/01288

§ 371 Date: Mar. 31, 1998

§ 102(e) Date: Mar. 31, 1998

[87] PCT Pub. No.: WO97/13433

PCT Pub. Date: Apr. 17, 1997

[30] Foreign Application Priority Data

Oct. 13, 1995 [SE] Sweden ..... 9503576

[51] Int. Cl.[7] ..... A47B 39/00

[52] U.S. Cl. ..... 297/172; 297/188.01; 297/423.25; 297/344.1; 297/257

[58] Field of Search ..... 297/172, 173, 297/174, 188.01, 337, 423.19, 257, 344.1, 344.14, 423.25, 423.38, 160, 232, 248; D6/336; 312/235.5, 235.9; 108/50.11, 59

[56] References Cited

U.S. PATENT DOCUMENTS

D. 225,190 11/1972 Van Syoc .
D. 287,075 12/1986 Colin et al. .
D. 346,071 4/1994 Sharar .
550,613 12/1895 Harvey .
636,543 11/1899 Milla .
1,385,432 7/1921 Derbyshire .
1,970,874 8/1934 Yawman .
2,168,910 8/1939 Merrill .
4,798,411 1/1989 Lin .
5,013,100 5/1991 Zich .
5,335,962 8/1994 Gera .
5,582,464 12/1996 Maymon .
5,833,308 11/1998 Strong, III et al. .

FOREIGN PATENT DOCUMENTS 29 902 1/1954 Finland .

*Primary Examiner*—Milton Nelson, Jr.
*Attorney, Agent, or Firm*—Fasth Law Offices Rolf Fasth

[57] ABSTRACT

A desk that includes a desk top that has a forward book support surface having an equilateral triangle shape that is movable between a raised position and a lowered position about a base of the support surface. The support surface has sides that each form a front side edge of the desk top when the support surface is in the lowered position. A writing surface is attached to the base and has opposite side edges that coincide with a periphery of an imaginary circle that is parallel with the writing surface. The support surface is disposed inside the imaginary circle when the support surface is in the raised position and has a front portion that extends outside the periphery of the imaginary circle when the support surface is in the lowered position.

16 Claims, 9 Drawing Sheets

DESK AND GROUP OF SIMILAR DESKS

TECHNICAL AREA

The subject invention relates to a desk, especially for but not limited to school environments, comprised of a stand and a desktop supported by the stand. The desk includes preferably also an integrated chair. The desk according to the invention is meant to be placed together with other desks of the same type in different configurations.

TECHNICAL BACKGROUND

Traditional classroom furniture arrangement in rows and columns is not ideal since the students see the backs of other students' heads or don't see them at all. Even if the desks are arranged in a horseshoe, most students will be sitting ergonomically incorrectly, turned at an angle towards the teacher. Neither is the use of large round tables an acceptable solution since many students will be sitting with their backs to the teacher.

Another disadvantage of the traditional classroom furniture arrangement is that it is no: possible to vary the sitting position to any real extent, and that the furniture is relatively low which is a disadvantage for both student and teacher.

FI 29 902 describes a desk comprised of a stand and a desktop supported by the stand. The desk includes an integrated chair. The desktop has a triangular form, and four desks are meant to be positioned opposite each other during group work so that the desktops can be next to each other.

SUMMARY OF THE INVENTION

The purpose of the invention is to correct the above-mentioned disadvantages of traditional school furnishing. It should be emphasized, however, that the use of the desk is according to the invention not limited to schools.

A particular purpose of the invention is to provide a desk that makes it possible to easily and quickly shift the furniture arrangement between individual work, traditional teaching, group work, discussion, and so on.

The submitted, not-restricting embodiments of the invention will now be described in more detail with reference to the attached drawings.

FIGURE DESCRIPTIONS

DESCRIPTION OF THE SUBMITTED EMBODIMENTS

FIGS. 1 to 10 show a first embodiment of a desk according to the invention. The same identifiers are used for the same parts throughout the figures. The desk shown is especially, but not exclusively, useful as a school desk in a classroom and is designed with particular account taken of the different needs found in such an environment, such as use for both individual work and group work, ergonomics, adjustability for different students, room cleaning, durability, etc.

The desk, identified by 10, has as main components a desktop 20, a stand 40, and an integrated seat 50. These three main components will now be described individually.

Desktop

Figure 1:
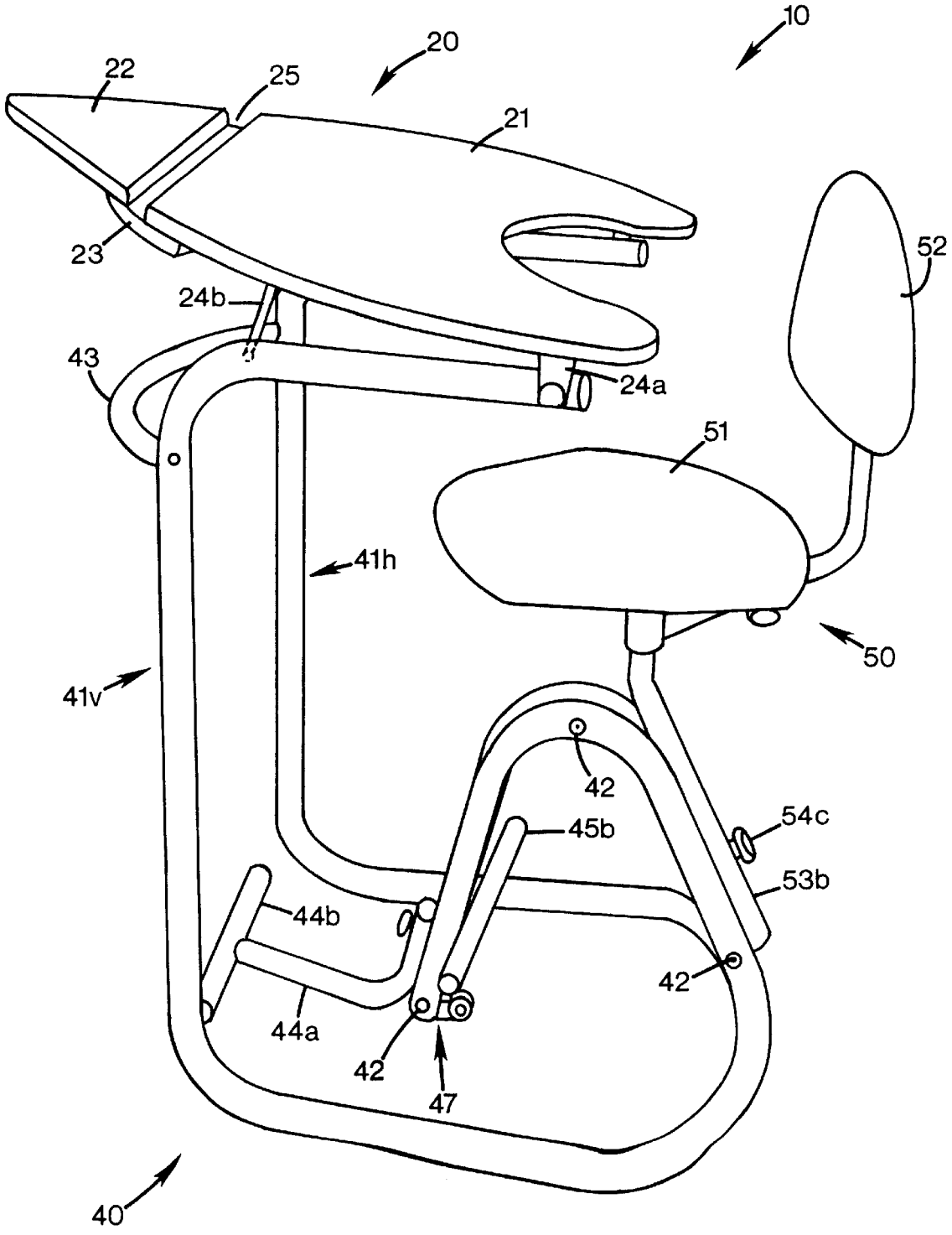
FIG. 1 is a perspective view of the first submitted embodiment of a desk according to the invention.
Figure 3:
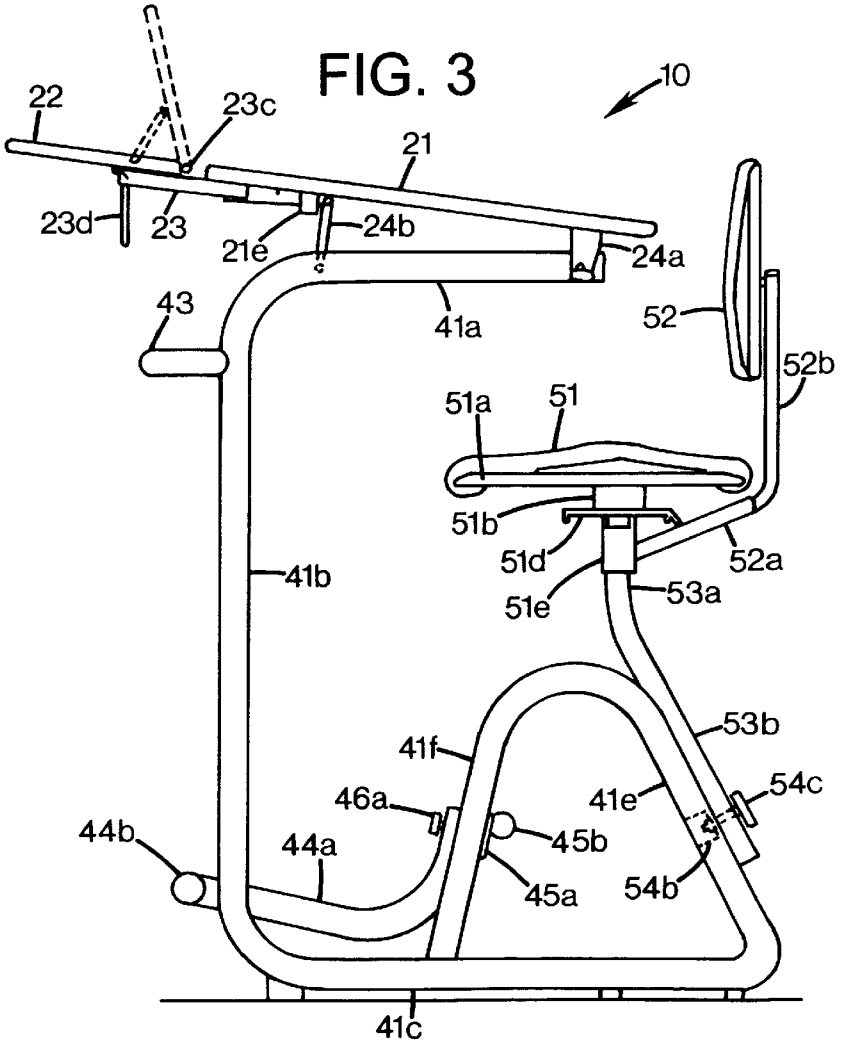
FIG. 3 is a side view of the desk in FIG. 1.
Figure 4A:
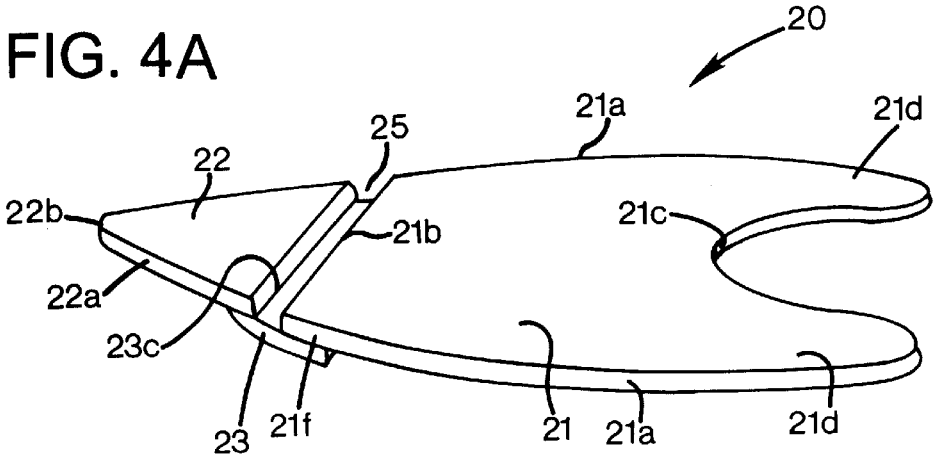
FIG. 4A is a perspective view of the desktop of the desk in FIG. 1.
Figure 4B:
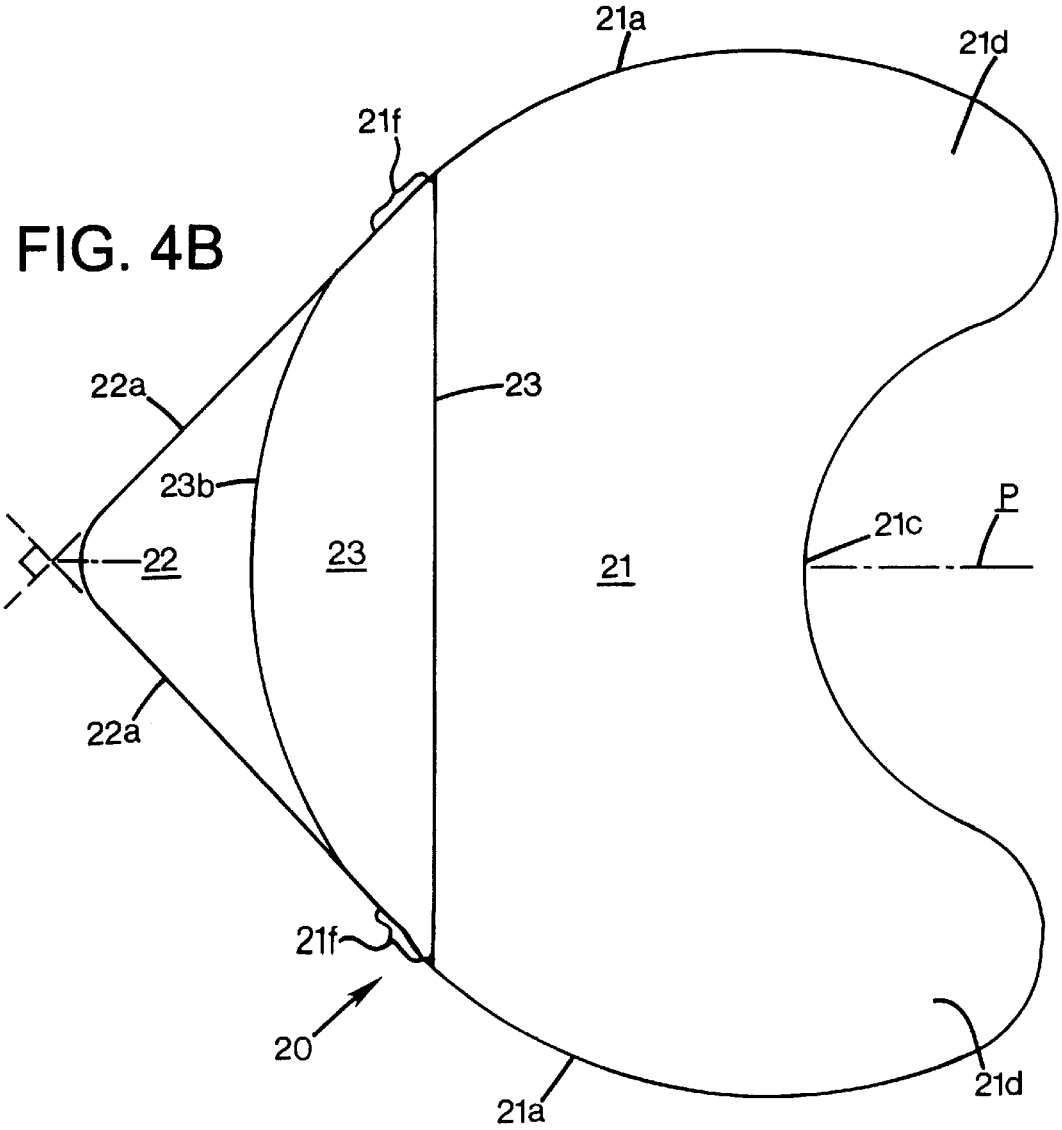
FIG. 4B is a bottom view of the bottom of the desktop in FIG. 4A.

As seen best in FIG. 3, 4A, and 4B, the desktop 20 is composed of a writing surface 21 and a book support surface 22 that can be raised and lowered, which are held together by a lower connection plate 23. The back of the latter is solidly attached to the bottom of the writing surface 21, while the front is movably attached via a piano hinge 23*c* to the book support surface 22. The book support surface 22 has the form of an equilateral right-angle triangle, the point of which forms the forward point of the desktop 20, and whose short sides when in folded down position form the two front side edges 22*a* of the desktop 20. The desktop 20 in the illustrated embodiment is symmetrical about a vertical mid-plane P through the desk (FIG. 4B). The book support surface 22 can be positioned to the desired angle using a sawtooth-formed arm 23*d*.

The writing surface 21 can be made of any appropriate durable material, and the book support surface 22 is preferably made of the same material in order to form a unified work surface together with the writing surface 21 when folded down.

The writing surface 21 has two circularly curved side edges 21*a* that form part of a circle C (FIG. 5) with center O. In the illustrated embodiment the radius of circle C is approximately 40 cm. Each of these two circularly curved side edges 21*a* ends at the front in a short straight side edge 21*f*, which when the book support surface is folded down forms a rear extension of the side edge 22*a*. The forward limit of writing surface 21 is a straight edge 21*b* that connects with the forward ends of edges 21*f*.

Instead of completing the circle at the rear, the two circularly curved edges 21*a* become a central rear inwardly-curved recess 21*c* (FIG. 4A) towards the center O in the rear edge of the writing surface 21, so that two armrests or side work surfaces 21*d* exist between recess 21*c* and the side edges 21*a*. The forward edge of recess 21*c* forms a circular curve in this embodiment.

In the illustrated embodiment the center of circle O lies inside writing surface 21 very close to recess 21*c*. It is, however, possible to design writing surface 21 differently so that center O lies outside the rear edge of the surface.

Thanks to recess 21*c*, the seat 50 can be placed completely within circle C (FIG. 5), which especially has the advantage of allowing unlimited turning of the desk 10 with respect to adjacent desks of the same kind. It should, however, be noted that the seat back 52 in certain adjustment positions can lie somewhat outside circle C. Importantly, it is possible when necessary for the entire seat 50 to lie within circle C.

The entire desktop 20 has a fixed height next to the student's stomach, but can be tilted up at the front (FIG. 3). For this purpose writing surface 21 is rotatably attached to stand 40 via two mounts 24*a*. Desktop tilt is adjustable using a swingable mounting 24*b*. Identifier 21*e* refers to a support that rests against stand 40 when desktop 20 is lowered. An advantage of having a fixed height for the rear part of desktop 20 is that it makes it easier to group several desks 10 into a larger work table.

Figure 5:
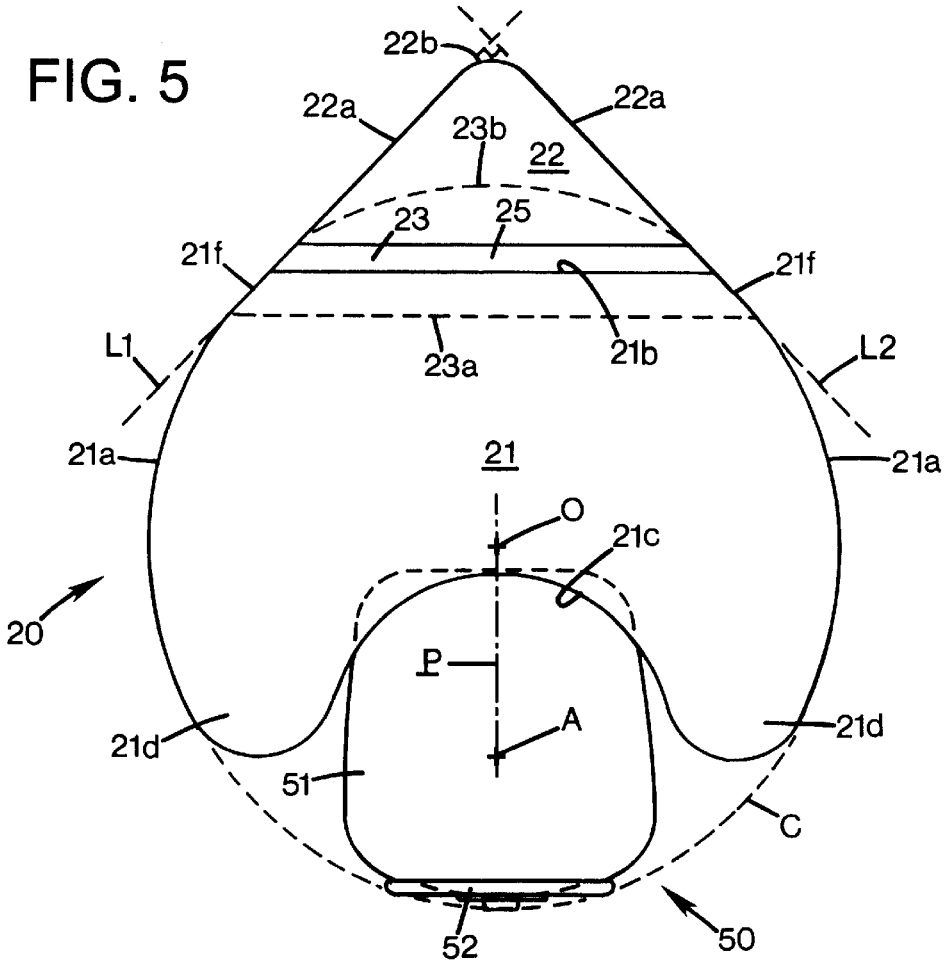
FIG. 5 is a top view of the desk in FIG. 1 with the stand omitted.

The following should be noted regarding the diameter of circle C (FIG. 5) that limits the side to side dimensions of the desk. In the illustrated embodiment circle C is the circle that defines and in this manner coincides with the circularly-curved side edges 21*a* of writing surface 21. In FIG. 5, the dashed lines indicate possible back extensions L1 and L2 that are tangent to circle C. The connection plate 23, which forms the bottom of pencil groove 25, also has a circularly-curved forward edge 23*b* (FIG. 4B), but since this edge 23*b* for reasons of suitability starts at the ends of the front edge of pencil groove 25, the circularly-curved edge 23*b* will be defined by a marginally larger circle. In this embodiment the last-mentioned radius increases from approx. 800 mm to approx. 808 mm. This forward displacement of the circle at the front part of desk 10 has, however, a negligible effect on whether adjacent desks bump into each other when they are turned, since during use it is not probable that the desks will be turned about an exact center O. With reference to this, it applies generally to the invention, and especially its definition in the patent claim, that reference to statements of the type "lies completely within the circle" and similar expressions shall be assumed to also include cases where some parts of the desk lie slightly outside C but, however, within the larger circle defined by edge 23*b*.

Stand

The stand 40 (FIGS. 2, 3, 6A, and 6B) in the submitted embodiment is built up of two mirror-symmetrical steel tubing halves 41*v*, 41*h*, that are assembled together, of which each consists of the following sections in sequence starting at the top: an upper, straight horizontal section 41*a*; a front vertical post 41*b*; a base consisting of a lower straight horizontal section 41*c* and a lower inward-curved horizontal section 41*d*; an upward-forward leaning (approx. 28°) seat mounting section 41*e* approximately half as long as vertical post 41*b*; and a downward-forward leaning (approx. 12°) footrest mounting section 41*f* approximately as long as seat mounting section 41*e* which ends in a lower end 41*g* immediately above the lower limiting plane of the desk.

The stand halves 41*v*, 41*h* are connected together along symmetry plane P using three bolts 42 in mounting sections 41*e* and 41*f*. As best seen in the rear view in FIG. 2, the two seat mounting sections 41*e* diverge upwards from a mutual distance of approx. 10 mm to approx. 20 mm. This applies similarly to the two forward mounting sections 41*f*.

A horizontal curved tube 43 connects together the vertical posts 41*b* at the top. A certain mutual solidity of halves 41*v*, 41*h* is also achieved through having the back ends of horizontal sections 41*a* mutually connected via rear hinge mount 24*a* and writing surface 21 mentioned above.

Figure 6B:
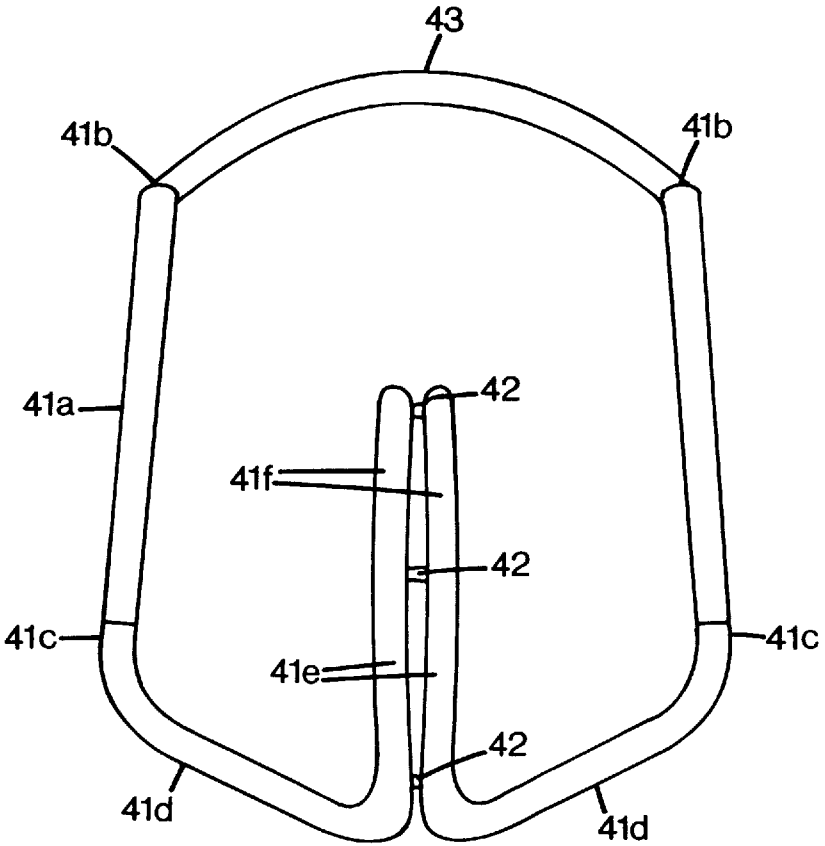
FIG. 6B is a top view of the stand in FIG. 6.
Figure 6A:
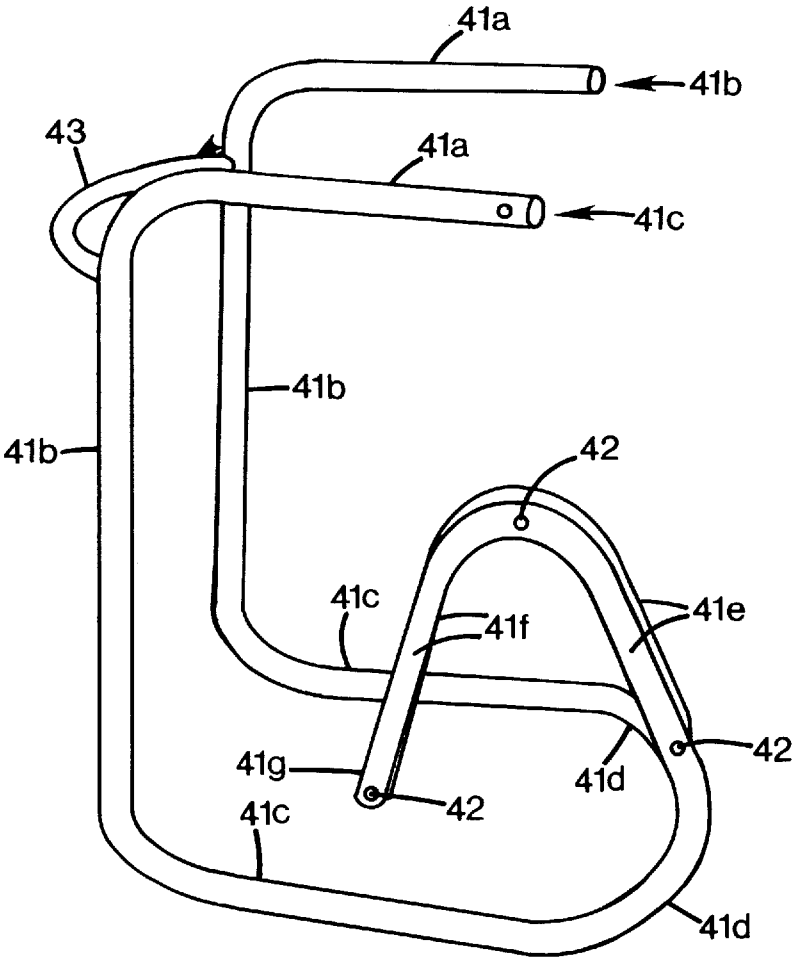
FIG. 6A is a perspective view of the stand of the desk in FIG. 1.

As seen in FIG. 6B the base (41*c*, 41*d*) of stand 40 has a relatively large extension sideways as compared with traditional furniture (separate table and chair), which especially makes desk 10 more stable from the viewpoint of tipping as compared with known desks with integrated seats. The sideways dimensions of stand 40 are, however, limited such that the stand lies completely within circle C.

Another advantage of the illustrated stand 40 is that the entire desk 10 can be made relatively high, which is good both for the student's sitting position (straight back and open hip angle) and for the teacher standing alongside who due to this does not have to bend his or her back. The relatively high height also makes it possible to adjust the seat and footrest heights within wide limits as described below.

An additional advantage of stand 40 is that seat 50 can be integrated in desk 10. This gives advantages such as simplified turning of the desk, regrouping of desks in the class room, elimination of chair scrape on the floor, etc. The manufacturing cost of stand 40 can be kept at a low level in spite of all the stand's advantages.

Seat

Seat 50 is, as stated above, integrated in desk 10. The seat bottom 51 and seat back 52 are together rotatable about a vertical rotation axis A (FIG. 5). Seat 50 is mounted in the area between the forward edge of recess 21*c* and circle C. Seat 50 including seat back 52 can thus be completely within circle C, which has the advantage that the student can turn himself or herself in different directions relative to the desktop without risk of bumping into adjacent desks. Thanks to the side armrests 21*d* the student has at least some work surface in front of him or her even if seat 50 is turned sideways. In the illustrated embodiment the side armrests 21*d* limit the rotation angle of the seat when seat back 52 bumps into side armrest 21*d*.

Figure 2:
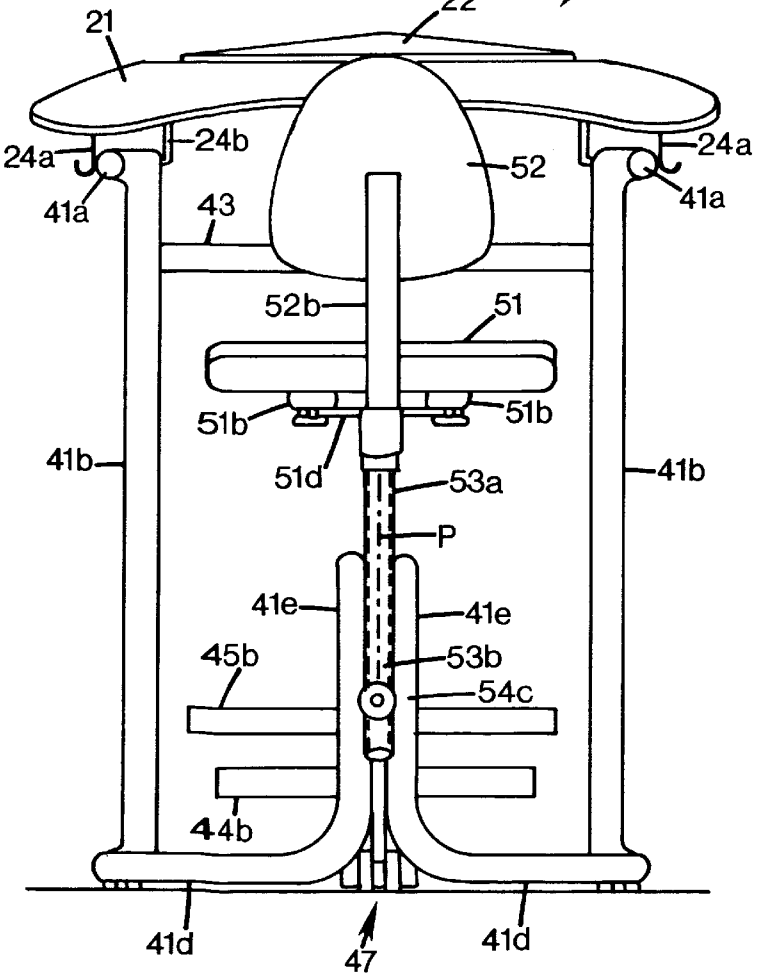
FIG. 2 is a rear view of the desk in FIG. 1.
Figure 10:
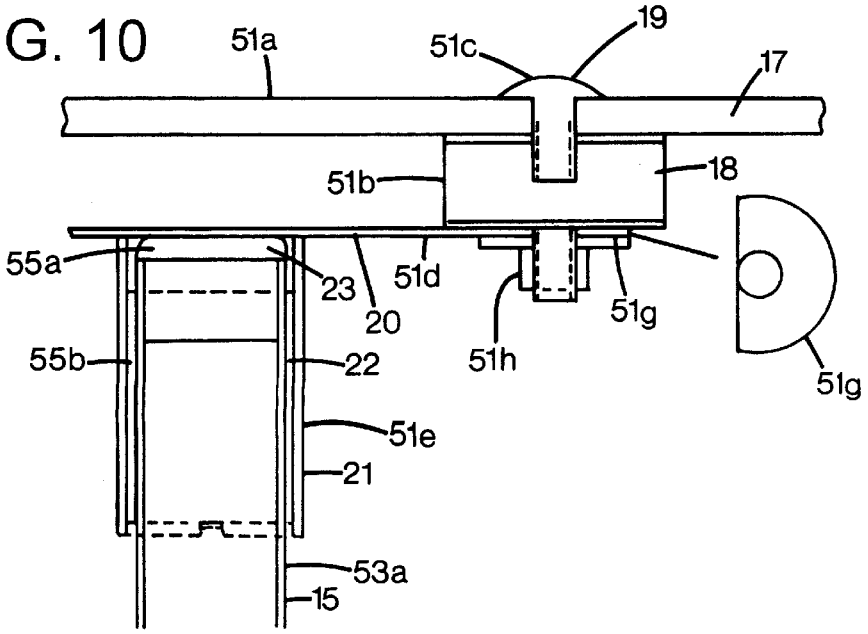
FIG. 10 is a broken-out cross-section from the front, that shows the seat mounting of the desk in FIG. 1.

FIGS. 2, 3, and 10 show how seat 50 is mounted on stand 40. The seat bottom 51 has a seat plate 51*a* on whose underside somewhat behind the crosswise mid-line of seat bottom 51 (see FIG. 3) are mounted two rubber shock absorbers 51*b* with mutual distance through bolts 51*c*. Each rubber shock absorber 51*b* contains a nut at the top and a bolt at the bottom, of which the latter is held by nut 51*h* in lower supporting plate 51*d*. As shown in FIG. 10, the bolt in rubber shock absorber 51*b* lies outside of the side edge of supporting plate 51*d* and therefor can be moved forward-backward to the desired position, so that seat bottom 51 can be fixed in position relative to supporting plate 51*d* using nut 51*h* and half-circular washer 51*g*.

In a straight tube 51*e*, which is welded to the underside of supporting plate 51*d* concentric with rotation axis A, an upper vertical section 53*a* of a seat mounting tube is rotatably inserted, where 55*a* refers to a thrust bearing and 55*b* refers to a sleeve bearing. The lower section 53*b* of the seat mounting tubing leans in the same direction as the seat mounting section 41*e* of stand 40, that is, approx. 28° from the vertical plane, and is attached in the space between these two mutually diverging seat mounting sections 41*e*. For this purpose, a bolt equipped with a height-setting wheel 54*c* is put through the mentioned lower section 53*b*, through seat mounting sections 41*e* and through a hole in a separate angle iron 54*b*, in order to connect with nut 54*a* that self-locks in the inner angle of angle iron 54*b*. When drawn tight the outside of the angle iron is pressed against the seat mounting sections 41*e*.

Thanks to the fact that seat mounting sections 41*e* lean forwards-upwards, and that seat mounting tubing 53*b* is displaceable in the same direction, a shorter person automatically comes closer to desktop 20 when the seat is raised. This mounting and displaceability greatly simplify the positioning of the seat 50 relative to the desktop 20.

Thanks to the fact that seat mounting sections 41*e* diverge upwards from each other, the seat 50 can be firmly positioned at the selected height. The more weight there is on the seat the firmer it is held in place, since any backwards-downwards displacement of mounting tubing 53*b* results in it being automatically displaced backwards-upwards, that is, in the direction of the force exerted by bolt 54*c*. There is, however, no risk of undesired locking of stand 40 to the seat mounting tubing 53*b*, because the latter can move freely backwards-upwards away from stand 40 as soon as bolt assembly 54*a*/54*c* is loosened.

The seat back 52 is mounted using an upwards-backwards leaning mounting tubing 52*a* which is welded to the back of straight tube 51*e* and in which is inserted a downwards-forwards bent section of support tubing 52*b*.

Figure 8:
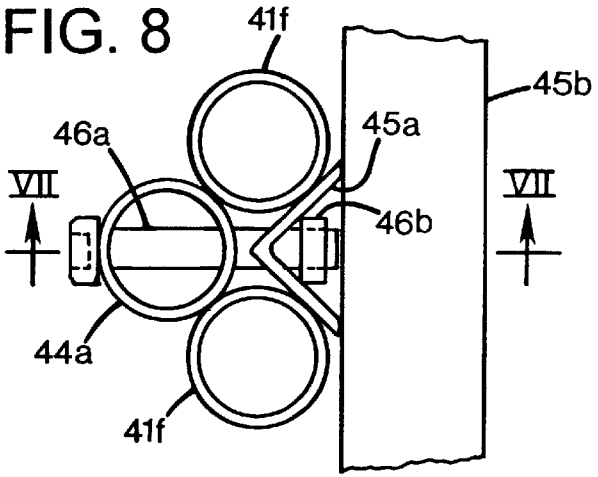
FIG. 8 is a broken-out cross section of the footrest arrangement, seen in a larger scale from above along line VIII—VIII in FIG. 7.

Footrest The desk in FIGS. 1–10 is also furnished with a footrest arrangement (see especially FIGS. 1, 3, 7, and 8) that is displaceably mounted on downward-forward leaning footrest mounting sections 41*f* which are part of stand 40. The footrest arrangement includes a front footrest and a rear footrest. The front footrest is made of a support arm 44*a* which lies in symmetry plane P and which at the front supports a transverse footrest tube 44*b*. Support arm 44*a* is angled upwards 90 U at the rear and is attached using bolt 46*a* to the upwardly diverging space between footrest mounting sections 41*f* (FIG. 8). When necessary, if the student is short, the front footrest can be rotated 180 U upwards relative to the position in FIG. 7.

The rear footrest is made of a transverse footrest tube 45*b* which is welded to an angle iron 45*a*. The point of angle iron 45*a* is inserted in the diverging space between the footrest mounting sections 41*f*, and the above-mentioned bolt 46*a* passes through the point of angle iron 45*a* and is threaded in nut 46*b* which, similarly to the seat mounting above, self-locks against the inside of angle iron 45*a*.

The furnishing of double footrests fosters an ergonomically varied sitting position. The space between the footrest mounting sections 41*f* of stand 40 diverges upwardly from each other for the same reason as for the seat mounting. Similarly, that the footrest mounting sections lean upward-backward results in an automatic compensation of the horizontal position of the footrest when it is adjusted in height—a short student automatically has the footrest nearer to the rotation axis of seat 50.

It can be seen that desk 10, thanks to the above-described principles for mounting and adjustment of the seat and the footrest, can be used for people of all ages.

Moving Device

As mentioned above, it is easy to turn or move desk 10 to new groupings thanks to the fact that desktop 20 and seat 50 are integrated with each other. To further simplify this, desk 10 has a central moving device referred to generally by 47. This is shown in detail in FIGS. 7 and 9. Moving device 47 is composed of a moving wheel 47*a* that is rotatably bearing-mounted on a raisable-lowerable pivoting wheel arm 47*b*. Wheel arm 47*b* is pivotably mounted for movement in symmetry plane P in the lower end 41*g* of stand 40 via joint pin 47*c* (which here can be one of the bolts 42). A stop 47*d* limits the frontward rotation of wheel arm 47*b*.

Figure 7:
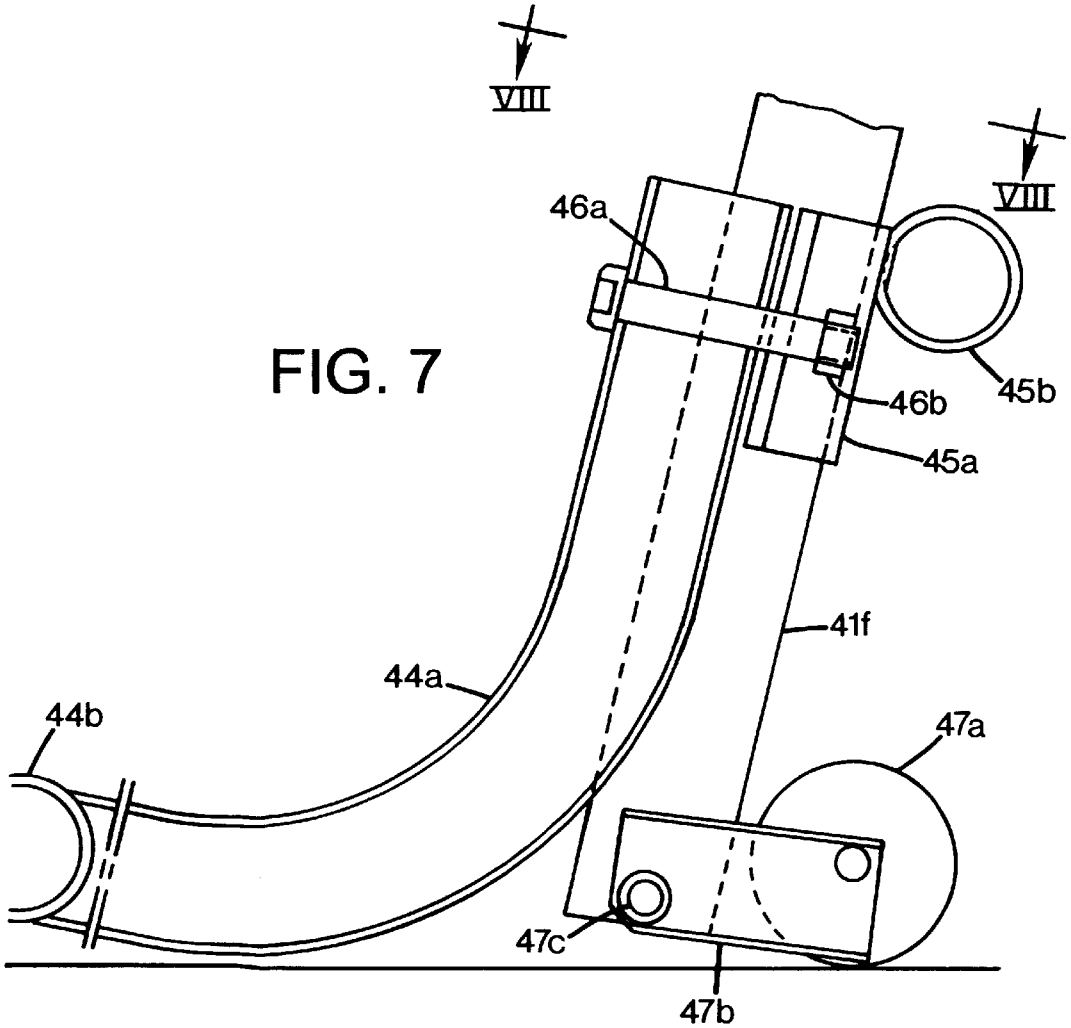
FIG. 7 is a broken-out side cross section of a footrest arrangement and a moving device of the desk in FIG. 1, seen from the side along line VII—VII in FIG. 8.

When desk 10 stands on the floor as in FIG. 3, the moving wheel rests lightly on the floor as in FIG. 7. When desk 10 is to be moved and/or turned, the desk is lifted somewhat, for example, at the front, high enough so that wheel arm 47*b* with wheel 47*a* fall down to the moving position shown in FIG. 9. Desk 10 will then rest partly on wheel 47*a* and partly on parts of the base of stand 40. In this position it is easy to maneuver the desk to the correct position, for example, by lifting slightly the back part of the desk.

Figure 9:
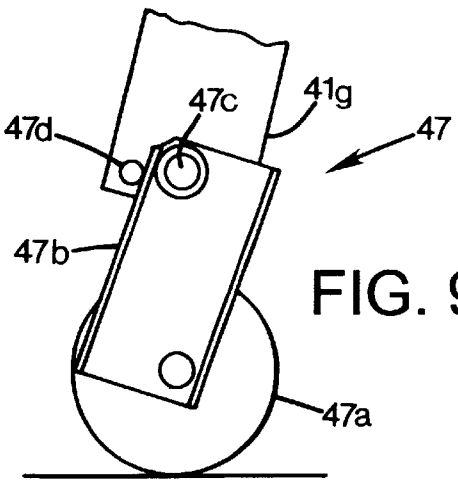
FIG. 9 is a broken-out side view in a larger scale of the moving device in FIG. 7.

When in the moving position as in FIG. 9, also cleaning under desk 10 is made easier, and it can be seen that such a cleaning-simplifying construction does not necessarily require using moving wheel 47*a* but only a raisable-lowerable support with which the desk can be placed in a raised position from the floor.

Groupings

Figure 16:
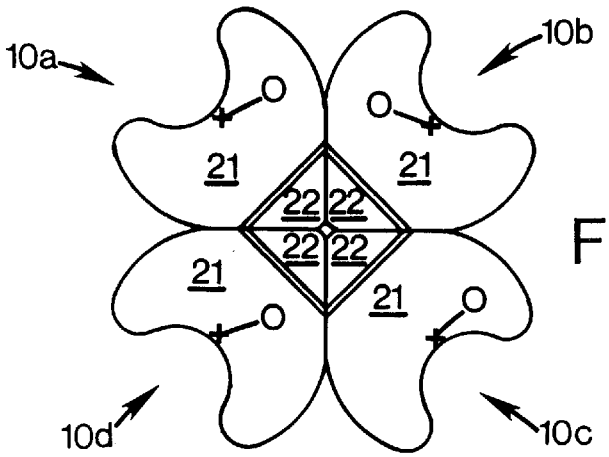
FIG. 16 is a schematic top view that visualizes four desks according to FIG. 1 or FIG. 11, arranged in a first configuration.
Figure 17:
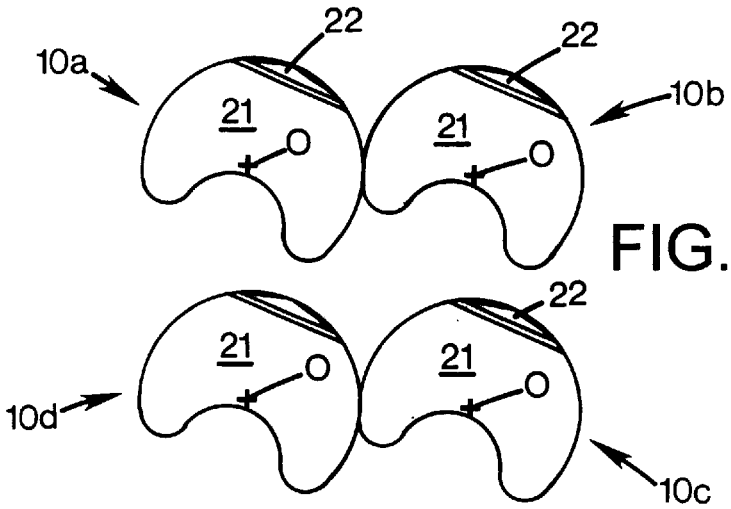
FIG. 17 is a schematic top view that visualizes four desks according to FIG. 1 or FIG. 11, arranged in a second configuration.
Figure 18:
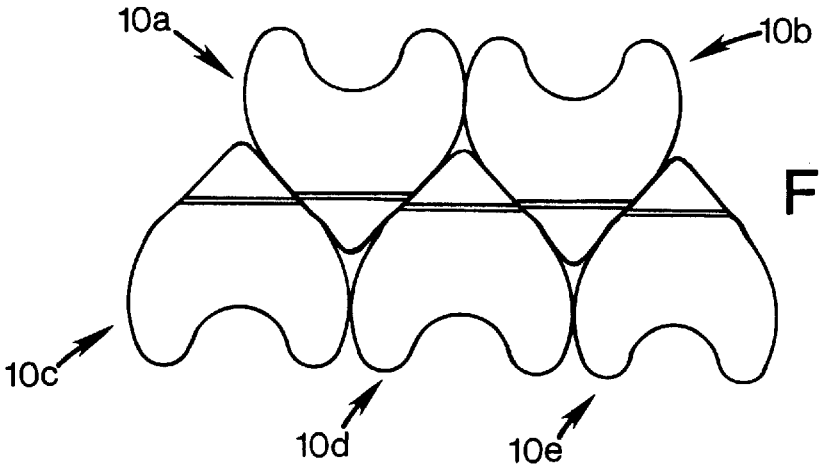
FIG. 18 is a schematic top view that visualizes five desks according to FIG. 1 or FIG. 11, arranged in a third configuration.

Referring to FIGS. 16–18, three possible ways to group desk 10 according to the above-described embodiments are illustrated. For the sake of clarity, both stand 40 and seat 50 are omitted.

FIG. 16 shows a group of four desks 10*a*–10*d*, with the same construction as the above-described desk 10, arranged in a first configuration for group work or similar. Desks 10*a*–10*d* lie, as before, each within its circle C as in FIG. 5, and the desks are placed so that the centers O of the related circles lie each in a separate corner of a square and so that the four circles are tangent to each other. In this first configuration in FIG. 16, all desktops 21 and book support surfaces 22 are preferably folded down. Desks 10*a*–10*d* are turned towards a common central point so that the four book support surfaces 22 together form a square which is part of a larger work area formed by the four desktops 20. It can be seen that the fixed desk height at the back edge of the writing surface 21 is a factor that facilitates this configuration. It should also be noted that this grouping, compared with grouping of traditional rectangular desks, is advantageous because the students sit in a circle and can see each other better.

FIG. 17 shows the same group of desks 10*a*–10*d*, but now placed in a second configuration for individual work. Compared to the configuration in FIG. 16, each desk has now been turned about its own circle center O in varying degrees. Thanks to the fact that each desk 10 lies within its own circle C, and that these circles are only tangent to each other, it becomes possible to by only rotating the desks switch between these two configurations. It can be seen that the book support surfaces 22 are preferably in the upright position during such movement.

FIG. 18 shows a group of five desks 10*a*–10*e*, arranged in a third configuration for group work. This configuration can naturally be used for both more and fewer desks than five. In this configuration, the students can especially turn towards their neighbors and even so have a writing surface—armrest 21*d*—in front of them, thanks to the design of the desktop 21.

Embodiment With Drawer

FIGS. 11–15 show a second embodiment of a desk according to the invention, which is mainly identical to the desk in FIGS. 1–10 except that it has a drawer that is open at the top under desktop 23. The components that are identical in the two embodiments have the same identifiers, and a repeated description of these components is not provided.

Figure 12:
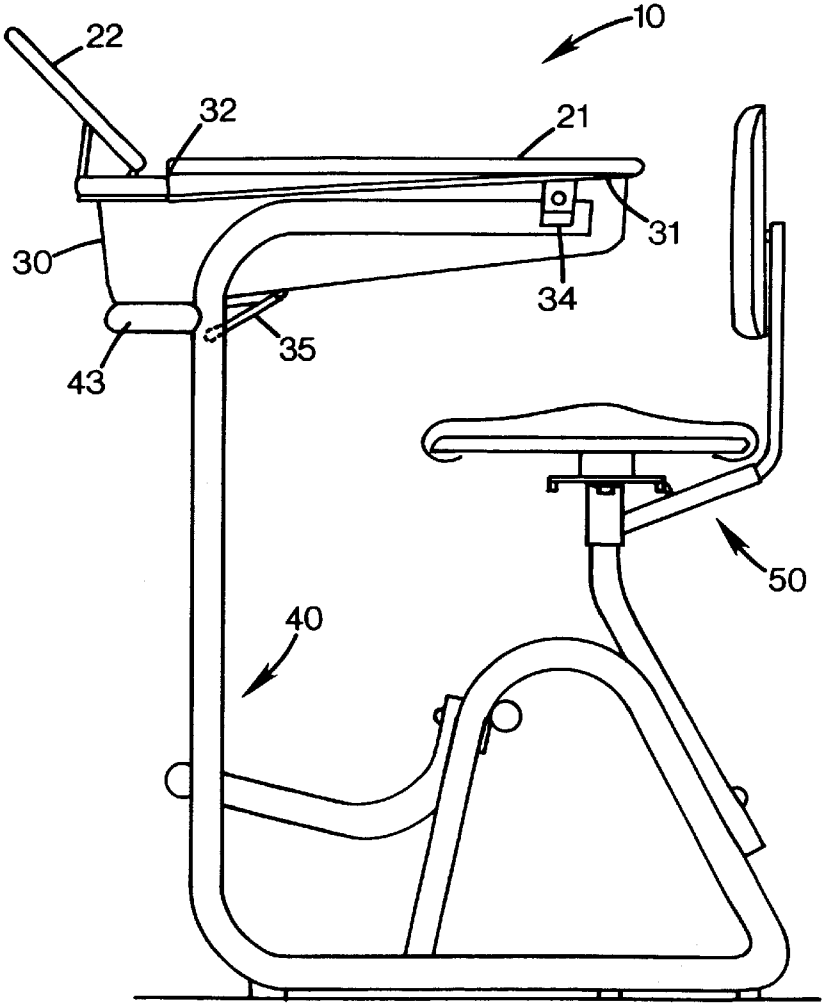
FIG. 12 is a side view of the desk in FIG. 11.
Figure 11:
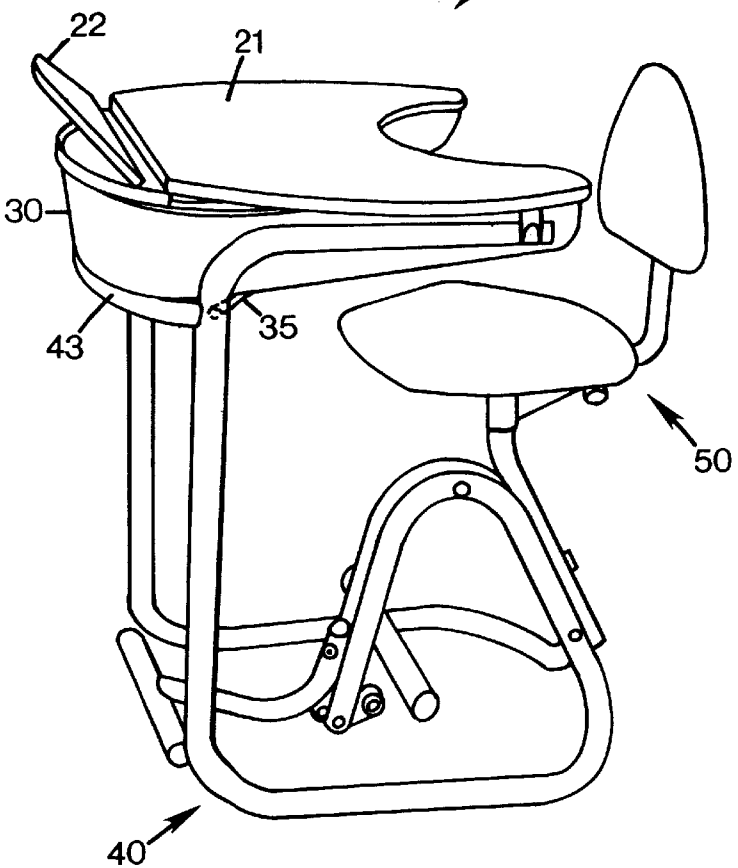
FIG. 11 is a perspective view of another submitted embodiment of a desk according to the invention, including a storage drawer.
Figure 15:
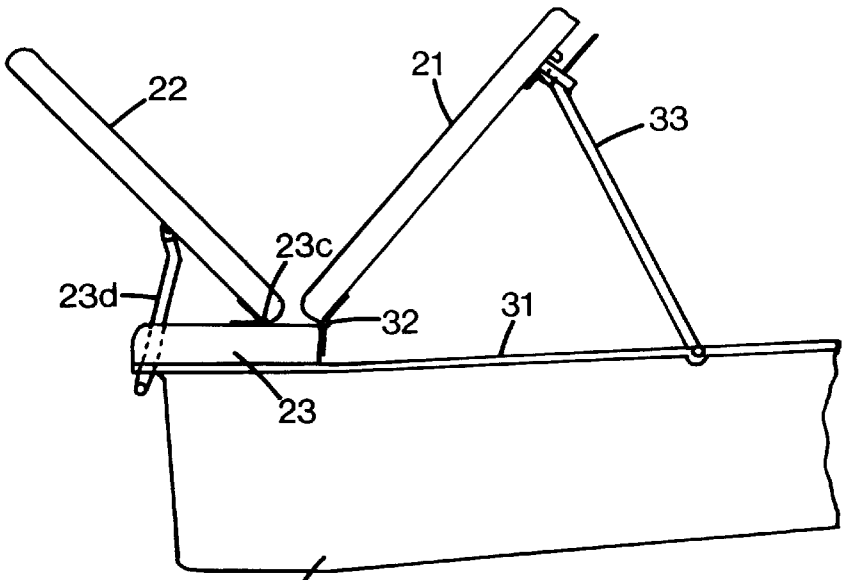
FIG. 15 is a broken-out side view in a larger scale of the desktop and drawer in FIG. 13.
Figure 14:
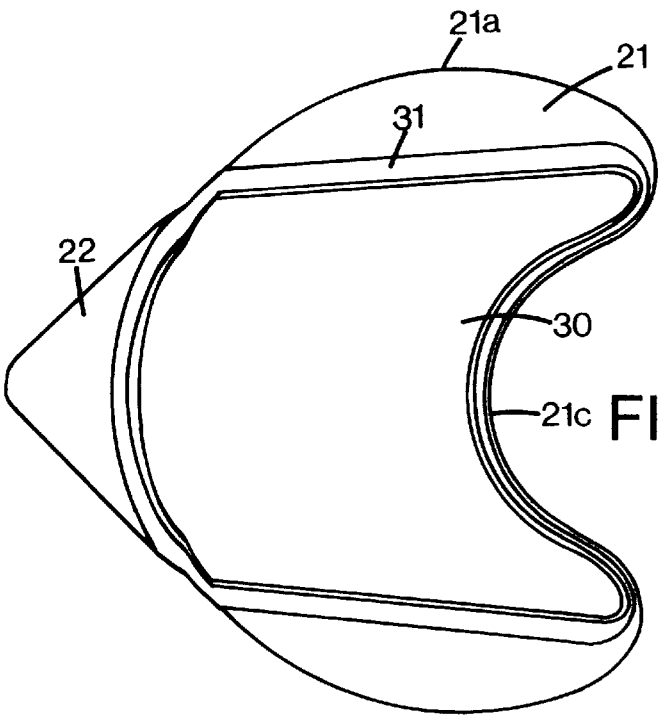
FIG. 14 is a bottom view of the bottom of the desktop and drawer in FIG. 13.
Figure 13:
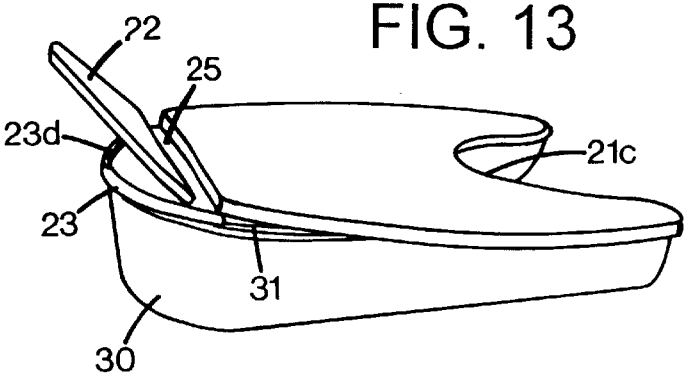
FIG. 13 is a perspective view of a desktop with drawer of the desk in FIG. 11

Drawer 30 extends under both the writing surface 21 and the connection plate 23, and has a form that at the rear meets with recess 21*c* and at the front meets with the curved front edge 23*b* of the connection plate 23. Drawer 40 lies thusly completely within circle C. As illustrated in the bottom view in FIG. 14, the sides of drawer 30 lean slightly outwards and at the top they merge into a horizontal mounting and support flange 31, where connection plate 23 is firmly attached to flange 31. writing surface 21, which here acts as a cover, is at its front edge 21*b* pivotably connected with connection plate 23 via a piano hinge 32 and can be placed in a raised position using a liftable arm 33 as shown in FIG. 15. In the folded-down position, the rear part of writing surface 21 rests on drawer 30. Drawer 30 leans downward-forward so that writing surface 21 is horizontal in its folded-down position (FIG. 12). The book support surface 22 is raisable and lowerable is the same way as has been described earlier. Furthermore, the entire drawer 30 can be set at one or more different angles relative to stand 40 (not shown) because the drawer is pivotably mounted at the rear of its sides via bolt 34, which is mounted in the rear ends of horizontal arm sections 41*a*. In the folded-down position, drawer 30 rests on horizontal curved tube 43, and in the raised position a support arm 35 (not additionally described) is lifted up to support the drawer.

It can be seen that this embodiment with drawer can be arranged in the same configurations as the first embodiment, and that desks with and without drawers can be used at the same time within the same group.

I claim:

1. A desk including a desk top attached to a frame comprising:

a forward book support surface having an equilateral triangle shape, the support surface being movable between a raised position and a lowered position about a pivot point at a base of the Support surface, the support surface having sides and a rear edge, each side forming a front side edge of the desk top when the support surface is in the lowered position;

a writing surface attached to the base of the support surface, the writing surface having opposite side edges, each side edge having a convex shape that coincides with a periphery of an imaginary circle, the support surface being disposed inside the imaginary circle when the support surface is in the raised position, the support surface having a front portion extending outside the periphery of the imaginary circle when the support surface is in the lowered position; and the writing surface having a straight front edge that is parallel with the base and the writing surface has outwardly curved side edges that form rear side edges of the desk top.

2. The desk according to claim 1 wherein the writing surface has a rear peripheral edge that defines a recess that is disposed between two arm rest sections.

3. The desk according to claim 1 wherein the desk and the frame are disposed inside the periphery of the imaginary circle.

4. The desk according to claim 1 wherein the frame comprises two front posts connected by an upper horizontal section that supports the desk top, the frame further comprises a lower horizontal section that is adapted to rest on a floor.

5. The desk according to claim 1 wherein the frame has a bottom attached to a movable wheel.

6. The desk according to claim 1 wherein the desk further comprises a drawer disposed under the writing surface.

7. The desk according to claim 1 wherein the side edges are circular.

8.The desk according to claim 7 wherein the front side edges of the support surface form a tangent with the periphery of the imaginary circle.

9. The desk according to claim 1 wherein the desk top further comprises a lower connection plate that is attached to the writing surface and the support surface, the lower connection plate is disposed inside the periphery of the imaginary circle, the support surface is movably attached to the lower connection plate and rests against an upper side of the lower connection plate.

10. The desk according to claim 9 wherein a pencil groove is defined by the lower connection plate, the writing surface and the support surface, the lower connection plate forms a bottom of the pencil groove.

11. The desk according to claim 1 wherein a set of three additional desks are disposed immediately adjacent the desk to form a group, each desk has a pointed front edge pointing into a common center and each desk has side edges that are immediately adjacent one another so that the group of desks forms a polygon.

12. The desk according to claim 11 wherein the group comprises four desks.

13. The desk according to claim 1 wherein the desk further comprises a seat attached to the frame, the seat is disposed within the periphery of the imaginary circle.

14. The desk according to claim 13 wherein the seat has an adjustment mechanism attached to the frame so that a horizontal position of the seat is adjustable relative to the desk top.

15. The desk according to claim 14 wherein a rear arm is attached to a lower horizontal section, the rear arm is attached to a seat mounting section that has one end that is movably attached to a support arm, the support arm is attached to the seat.

16. The desk according to claim 15 wherein the seat mounting section comprises a footrest mounting section that extends downwardly and forwardly relative to the seat mounting section, the footrest mounting section has an adjustment mechanism to adjust a horizontal position of the footrest mounting section relative to the seat.

* * * * *